United States Patent [19]

Carter

[11] 4,089,486

[45] May 16, 1978

[54] WIRE DISPENSING APPARATUS

[76] Inventor: Earnest Ray Carter, 2515 N. 7th St., Phoenix, Ariz. 85006

[21] Appl. No.: 812,685

[22] Filed: Jul. 5, 1977

[51] Int. Cl.[2] ..... B65H 49/00

[52] U.S. Cl. ..... 242/129; 242/137.1

[58] Field of Search ..... 242/105, 129, 134, 137, 242/137.1, 138, 129.62, 54 R; 254/134.3; 225/46, 47

[56] References Cited

U.S. PATENT DOCUMENTS

| | | | |
|---|---|---|---|
| 2,954,942 | 10/1960 | La Raus | 242/129 |
| 3,136,496 | 6/1964 | McMartin | 242/54 R |
| 3,275,263 | 9/1966 | Parkinson | 242/129 |
| 3,392,960 | 7/1968 | Bye | 242/129 X |
| 3,593,943 | 7/1971 | Collman | 242/129 |

*Primary Examiner*—Leonard D. Christian
*Attorney, Agent, or Firm*—H. Gordon Shields

[57] ABSTRACT

Wire dispensing apparatus includes a movable plate disposed in a tub, with both the plate and tub secured to a fixed base, and wire is dispensed from the plate through an aperture in the wall of the tub.

14 Claims, 5 Drawing Figures

WIRE DISPENSING APPARATUS

BACKGROUND OF THE INVENTION

1. Field of the Invention

This invention relates to wire dispensing apparatus, and, more particularly, to apparatus for dispensing wire from coils disposed within the apparatus.

2. Description of the Prior Art

Wire used commercially in buildings, such as office buildings, homes, and apartment buildings, is typically single conductor wire with a coating of insulation disposed on the conductor and wound in coils. Two or three conductor wires, each conductor of which is insulated from the other conductors, may also be coated with a single sheet and again disposed in a coil from which the wire is used at construction sites. The coils of insulated wire are normally packaged in cardboard cartons which may weigh from about fifteen pounds to about forty pounds, depending on the size of the wire. The wire coils vary from about four inches to about 6 inches in height. The inside diameter of the coils also may vary. Each coil of wire contains from about 250 feet to about 500 feet of wire.

The wire must be uncoiled by the electrician for installation. If more than one conductor is required, as for example two or three conductors, the problem of aligning the separate conductors and dispensing the conductors from their individual, respective coils becomes a substantial problem in both time and effort. The obvious solution is to dispense the wire from wire dispensing apparatus which is rotatable and one which, or in which, a coil of wire may be disposed.

In the prior art, several attempts have been made to provide reel apparatus for dispensing wire. For example, in U.S. Pat. No. 801,613, dated Oct. 10, 1905, a rotatable plate is disposed within a housing and wire is fed out of the housing. The wire dispensing apparatus is part of a larger, more complicated apparatus, in which the overall combination provides the dispensing of wire for a specific purpose. This patent provides a minimum requirement for wire dispensing apparatus, namely a rotatable reel or plate and a fixed base. The prior art patents and known apparatus all include basically these two elements. However, the elements are arranged differently in each of the specific patents.

U.S. Pat. No. 2,816,718, dated Dec. 17, 1957, also provides a fixed base and a movable turntable or plate on which wire is dispensed. The apparatus is an electric lamp cord reel from which the lamp cord is pulled and into which it may be rewound for later use.

U.S. Pat. No. 2,895,691, patented July 21, 1959, includes a multi-reel configuration for dispensing a plurality of wires or conductors substantially simultaneously. The apparatus of this invention comprises a multi-tiered apparatus in which the diameter of succeedingly higher tiers decreases. Accordingly, the bottom tier or layer is designed to hold more, or larger, wire than the succeeding tiers above it. Each tier is rotatable on a spindle or axis.

U.S. Pat. No. 2,954,942, patented Oct. 4, 1960, discloses a combination of wire dispensing reel and a carrying case for the reel. Two separate coils of wire may be disposed within the carrying case. The apparatus includes a lid for insuring that the coils of wire remain in desired locations.

U.S. Pat. No. 3,275,263, dated Sept. 27, 1966, discloses another type of wire dispensing apparatus which includes either a single tier or a multi-tiered or multi-layered configuration. Each tier is of substantially the same diameter and accordingly holds the same amount of wire as each other tier. The apparatus which holds the reels of wire rotates on a fixed base and includes an actuating arm which comprises a brake for the apparatus. When outward tension is applied to a conductor, an actuating arm is raised which releases the brake and allows the wire to be removed from a rotating turntable which holds the wire. When tension on the wire is released, the actuating arm pivots downwardly under its own weight to apply the brake to stop the wire from continuing to feed outwardly.

The wire dispensing reel apparatus of the prior art, as indicated, each provide primarily a rotating or revolving platform disposed on a fixed base and a coil or reel of wire is disposed on the platform. The wire is pulled outwardly from the apparatus and in response to the pulling or movement of the wire, the platform rotates to unwind the wire.

Each of the apparatus of the prior art has its own inherent disadvantages, which range from lack of mobility to expense in purchasing, and to inoperability in various degrees.

SUMMARY OF THE INVENTION

The apparatus disclosed and claimed herein comprises wire dispensing apparatus which includes a fixed base, a tub rotatably secured to the base, and a plate disposed within the tub for holding the wire and movable relative to the tub, and both the tub and the plate are movable independently of the other and relative to the base.

Among the objects of the present invention are the following:

To provide new and useful wire dispensing apparatus;

To provide new and useful apparatus for selectively dispensing wire from a rotatable plate;

To provide new and useful apparatus for dispensing wire having a pair of rotatable elements secured to a fixed base;

To provide new and useful apparatus for dispensing a wire from independently rotatable elements; and To provide new and useful apparatus which provides relative motion with respect to a fixed base.

DESCRIPTION OF THE PREFERRED EMBODIMENT

Figure 1:
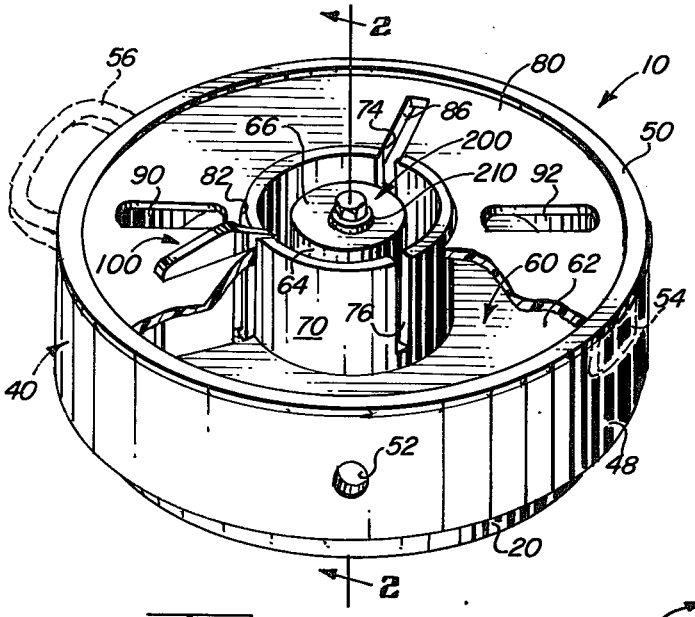
FIG. 1 is a view in partial section of wire dispenser apparatus of the present invention.
Figure 2:
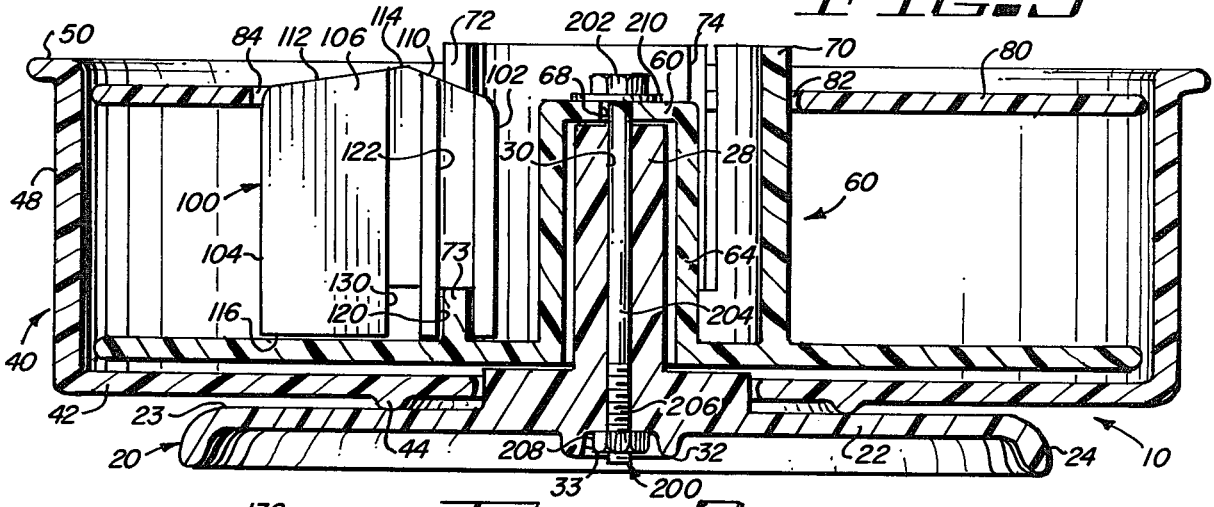
FIG. 2 is a view in partial section of the apparatus of FIG. 1 taken generally along line 2—2 of FIG. 1.

FIG. 1 is a perspective view of wire dispenser apparatus 10 embodying the present invention. The wire dispenser apparatus 10 includes a base 20, which is fixed, relative to a tub 40 which is disposed on the base. The base 20 includes a cylindrical wall portion 48 which extends upwardly from a bottom portion 42 (see FIG. 2) and which is disposed on the base 20. Within the tub is a carrier 60 which includes a plate 62 and a pair of concentric cylinders 64 and 70. The cylinder 64 comprises an inner cylinder and the cylinder 70 comprises an outer cylinder. The outer cylinder 70 includes three equally spaced slots, of which slots 74 and 76 are clearly shown in FIG. 1. Each of the slots receive a spacer 100. The spacers will be discussed in detail below in conjunction with FIGS. 2 and 3. The spacer 100 in FIG. 1 is received in a slot 72, as shown in FIG. 2. Slot 72 is the companion slot to slots 74 and 76.

A lid 80 fits within the tub 40 and downwardly about the outer cylinder 70 of the carrier 60. The lid 60 includes a central aperture 82 which is slightly larger in diameter than the exterior diameter of the outer cylinder 70 of the carrier 60. Extending radially outwardly from the central aperture 82 are three slots which receive portions of the spacers 100. A slot 86 is clearly shown in FIG. 1, and the spacer 100 shown in FIG. 1 is received in a slot 84, as shown in FIG. 2. The third slot is not shown in FIG. 1 because the lid 80 is broken away to illustrate other features of the apparatus.

The lid 80 also includes a pair of apertures or windows 90 and 92 which are preferably disposed diametrically opposite each other. A coil of wire is disposed within the tub 40 and on the plate 62 of the carrier 60. After the coil of wire is placed on the carrier 60 within the tub 40, the lid 80 is then placed on the coil of wire and serves to prevent the wire from coming loose, thus keeping the wire in the tub as wire is dispensed. The windows 90 and 92 allow a user to determine by observation how much wire remains within the apparatus 10.

The inner cylinder 64 is spaced apart from the outer cylinder 70 to allow a portion of the spacer 100 to extend radially inwardly from the outer cylinder 70. The top of the inner cylinder 64 includes an inwardly extending flange 66. The base 20, the top 40, and the carrier 60 are all secured together by a bolt 200, which includes a head 202 shown in FIG. 1 disposed on a washer 210. The washer 210 is shown supported by the inwardly extending flange 66 of the inner cylinder 64. It will be noted that the height of the outer cylinder 70 is slightly greater than that of the inner cylinder 64.

Wire from the coil disposed within the apparatus is dispensed outwardly through an aperture 52 of the tub 40. The aperture 52 is preferably somewhat larger than the maximum diameter of wire expected to be dispensed from the apparatus. For convenience, the aperture 52 is preferably located substantially downwardly from a rim 50 of the tub. The rim 50 extends radially outwardly from the top or upper portion of the cylindrical wall 48 of the tub 40.

In place of lid 80, a top cover may be secured to the tub 40. Such top cover may be secured to the tub by an appropriate hinge 54, shown in phantom. Diametrically opposite the hinge 54 is a handle 56, also shown in phantom. A matching handle on the lid would allow the apparatus 10 to be carried from location to location in a convenient suitcase like manner. A top would require slots, an aperture, and windows, such as shown for the lid 80. The top and lid differ primarily in the fact that the top would be hinged to the tub, and thus pivots on the tub, while the top 80 is removable.

FIG. 2 is a view in partial section of the wire dispenser apparatus 10 of FIG. 1 taken generally along line 2—2 of FIG. 1. The wire dispenser apparatus 10 is shown with the tub 40 disposed above the base 20, and with the carrier 60 disposed within the tub 40.

The base 20 comprises a circular platform 22 with a downwardly extending rim portion 24 disposed at the outer periphery of the platform 22. The base, and accordingly the entire wire dispenser apparatus 10, rests on the rim 24. The top surface of the platform 22 is identified by reference numeral 23. A central boss 26 extends upwardly from the top surface 23 of the platform 22. Surmounting the circular boss 26 is a cylindrical portion 28 which extends upwardly from the boss 26. Within the cylindrical portion 26, and extending through the boss 26 and the platform 22, is a passageway 30 which receives a shank portion 204 of the bolt 200.

Extending downwardly from the bottom of the platform 22 is a hexagonally shaped wall 32. The wall 32 defines a socket 33 which receives a nut 208. The nut 208 engages a lower threaded portion 206 of the bolt 200 to secure together the base 20, the tub 40, and the carrier 60, to comprise the wire dispenser apparatus 10.

The length (or height) of the downwardly extending rim 24 of the platform 22 is preferably greater than that of the wall 32 to prevent interference between the bolt 200 and the surface on which the base 20 is disposed.

The tub 40 includes a round bottom 42 which is greater in diameter than that of the base 20. A runner 44 extends downwardly from the bottom 42 and is disposed on the top surface 23 of the platform 22 of the base. The runner 44 is preferably circular in configuration and comprises a bearing surface on which the tub 40 is situated and on which it rotates relative to the base 20.

The tub 40 also includes a central aperture 46 which receives the boss 26 of the base 20. The diameter of the aperture 46 is slightly larger than that of the boss 26 to allow the tub to rotate relative to the boss 26 and the base 20. As indicated in FIG. 2, the vertical height of the boss 26 above the top surface 23 of the base is greater than the combined height or thickness of the bottom 42 and the runner 44 of the tub 40. This provides adequate clearance between the plate 62 of the carrier 60 and the bottom 42 of the tub 40.

The cylindrical walls 48 of the tub 40 extend upwardly substantially perpendicular to the bottom 42. The wall 48 terminates in a radially outwardly extending flange 50. The flange 50 provides strengthening for the tub and also provides a convenient hand hold for lifting the apparatus. That is, a user may grasp the outwardly extending flange or lip at diametrically opposite locations to lift the apparatus and move it from one location to another.

Disposed within the tub 40 and supported on the top or upper surface of the cylinder 28 of the base 20 is the carrier 60. The carrier 60 comprises a plate 62 which is disposed substantially parallel to the bottom 42 of the tub 40 and spaced slightly upwardly from the top surface of the boss 26. A pair of cylinders extend upwardly concentrically with respect to each other from the top surface of the plate 62. They comprise the inner cylinder 64 and the outer cylinder 70. The inside diameter of the inner cylinder 64 is slightly greater than the outer diameter of the cylinder 28 of the base 20. Accordingly, the carrier 60 rotates freely about the cylinder 28 without any frictional engagement between the inside wall of the inner cylinder 64 and the outer wall or surface of the cylinder 28.

The inner cylinder 64 includes the inwardly extending flange 66 with a centrally located aperture 68 extending through the flange. The flange 66 comprises a top wall or head for the cylinder 64. The bottom side or surface of the flange 66 also comprises a bearing surface for the carrier 60. The flange 66 is accordingly disposed on the top surface of the cylinder 28.

Spaced outwardly from the cylinder 64 is the outer cylinder 70. The inside diameter of the cylinder 70 is substantially greater than the outer diameter of the cylinder 64 to provide a spacing between the two cylinders to accommodate the spacer 100, as discussed in detail below. The cylinder 70 extends upwardly above the inner cylinder 64 and slightly above the cylinder wall 48, including the flange 50, of the tub 40. The reason for the extended height of the cylinder 70 is to accommodate a full coil of wire to hold the coil completely within the tub 48. The cylinder 70 accordingly extends upwardly above the tub 40 a distance at least equal to the thickness of the lid 80.

The cylinder 70 includes a plurality of slots, three as illustrated and discussed herein, including a slot 72 in which is disposed the spacer 100. The slots are used to accommodate the spacers which in turn are only used when the interior diameter of a coil of wire is somewhat greater than the diameter of the outer cylinder 70 of the carrier 60. The slot 74 is also shown in FIG. 2. The slots in the cylinder 70 extend axially downwardly about two-thirds to three-fourths of the total height of the cylinder 70, which is the distance between the top of the cylinder 70 and the top surface of the plate 62.

Figure 3:
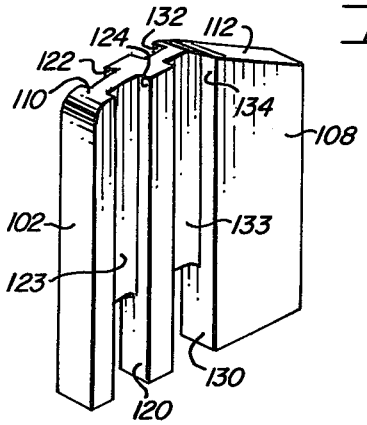
FIG. 3 is a perspective view of a spacer element illustrated in FIGS. 1 and 2.

The spacer 100 is shown in both FIGS. 2 and 3, and the spacer will be explained in conjunction with both Figures and generally without specific reference to either Figure. While FIG. 2 shows the spacer 100 in a full side view, FIG. 3 shows the spacer 100 isometrically. The Figures accordingly complement each other with respect to the overall features of the spacer.

The spacer 100 includes a pair of end walls 102 and 104 which are substantially parallel to each other and spaced apart from each other. The end walls 102 and 104 are substantially vertically extending and generally perpendicular to the plate 62 of the carrier 60. A pair of side walls 106 and 108, as best shown in FIG. 3, extend between the end walls. The end walls and side walls terminate in a generally flat bottom surface which is substantially perpendicular to all of the walls. Upwardly, the walls extend to a pair of top sloping surfaces 110 and 112. The top sloping surfaces 110 and 112 extend upwardly from the upper portion of the end walls 102 and 104, respectively, to meet or terminate in a ridge 114. As illustrated, the ridge 114 is near the center of the spacer with respect to the end walls 102 and 104. Extending upwardly from the bottom surface 116 of the spacer 100, which bottom surface is disposed on the top surface of plate 62, are a pair of recesses 120 and 130. The recess 120 is shown spaced apart slightly from the end wall 102, while the recess 130 is more remote from the end wall 102, but also remote from the end wall 104. A pair of grooves 122 and 124 extend downwardly from the top surface 110 to communicate with the recess 120. Similarly, a pair of grooves 132 and 134 extend downwardly from the top surfaces 110 and 112 to communicate with the recess 130. As shown in FIG. 2, the slot 72 of the outer cylinder 70 receives the slots 122 and 124 of the spacer 100, with the recess 120 disposed about a lower portion 73 of the outer cylinder 70 beneath the slot 72. The lower portion 73 comprises an upwardly extending portion of the wall of the cylinder 60.

The width of each of the grooves 122, 124, 132, 134, is substantially the same, The width is slightly larger than the wall thickness of the cylinder 70, which is received into the grooves. Between the respectively paired grooves is a web. Web 123 is disposed between grooves 122 and 124 and web 133 is disposed between the grooves 132 and 134. The thickness of the webs is slightly less than the width of the respective slots, such as slot 72, in the outer cylinder. Accordingly, when the spacer is disposed in the cylinder, it is held firmly in place.

Figure 4:
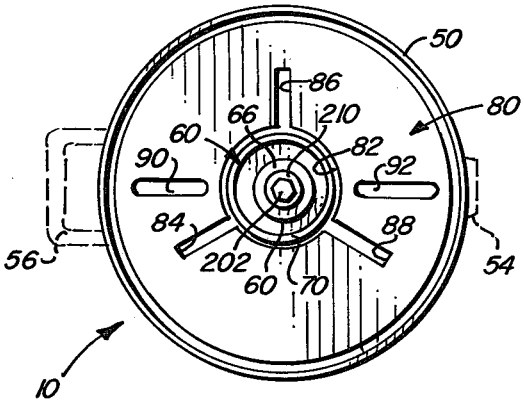
FIG. 4 is a top view of the apparatus of FIG. 1.

Since the wire dispenser apparatus illustrated herein and comprising the present invention may be used with various sizes and types of wire, adapters may be provided for accommodating two coils of wire having differently sized interior diameters. That is, wire coils of various manufacturers may vary with respect to the size of the coil form about which they are wound, and it is accordingly desirable to provide a variable diameter cylinder about which the wire coil may be disposed on a plate. Accordingly, each outer cylinder includes three slots, preferably equally spaced, such as illustrated in FIGS. 1 and 2, and comprising slots 72, 74, and 76. The lid includes three corresponding slots 84, 86, and 88, as shown in FIGS. 1, 2, and 4, which cooperate with spacers to provide a variable diameter cylinder about which wire may be disposed on each plate. The slots in the lid are slightly wider than the overall thickness of the spacers to prevent binding and to insure quick and easy installation of the lid.

The purpose of the sloping top surfaces 110 and 112 is to provide a convenient surface to prevent wire coils from hanging up on the top of the spacers as a coil of wire is disposed about the cylinder 70 and the spacer 100 on the plate 62. Since the spacer may be installed in any of four orientations with respect to the cylinder 72, the two sloping surfaces 110 and 112 are required.

The two recesses 120 and 130 provide a total of four compensating extensions to the diameter of the cylinder 70. As illustrated in FIG. 2, the maximum diameter is provided by the spacer 100 by having the recess 120, which is closest to the edge 102, disposed in the slot 72 and on the wall portion 73. The spacer 100 extends outwardly from the cylinder 70 a radial distance measured from the slot 120 to the edge 104. If a plurality of such spacers are used, at least two such spacers, diametrically opposed, or, as suggested herein, three such spacers, spaced equally apart on the outer cylinder, the diameter of the cylinder is thus enlarged by twice the distance from the recess 120 to the edge 104. By moving the spacer 100 inwardly so that the recess 130 is disposed in the slot 72, and on the wall portion 73, the radial distance, and accordingly the diametric distance, is reduced somewhat from the maximum shown. By reversing the spacer, as by reversing the edges 102 and 104 to provide that the edge 104 is disposed within the cylinder 70, the radial, and accordingly the diameter, distance is reduced again, depending on which recess, 120 or 130, is disposed on the slot 72. Thus four radial distances may be selected to increase the diameter of the cylinder 70, since the slots 120 and 130 are not symmetrically disposed with respect to the spacer 100. Each access and its corresponding grooves provide for the distances, depending on its orientation.

With the recesses and their respective grooves asymmetrically located with respect to the spacer 100, the spacer, or rather a minimum of two spacers, and preferably three such spacers, located equidistant from each other, may be used with the outer cylinder 70 to increase the diameter of the cylinder in four gradations, preferably from about one inch to about four inches. Each gradation increases the diameter by an amount of twice the distance from the particular recess (or slot on the cylinder) radially outwardly. For example, the slots 120 and 130 may be located with respect to the overall size of the spacer 100 to provide a distance of one inch from the side 102 to the recess 130, for a two-inch total increase in diameter of the cylinder 70. By then reversing the spacer 100 from the position shown in FIG. 2, and by locating or positioning the spacer such that the recess 130, with its grooves 132 and 134, are located in the slot 72, a three-inch increase in diameter may result with one and one-half inches of distance between the end 104 and the recess 130. A four-inch increase in diameter due to a two-inch distance between the end 104 and the recess 120 may also be obtained. The spacer thus allows for an appropriate increase in the diameter of the cylinder to accommodate coils of wire having various internal diameters. The spacers provide for selectively or variably increasing the effective diameter of the outer cylinder.

The lid 80 is shown in FIG. 2 as being a generally flat or planar lid, and it is circular in overall configuration as illustrated in FIGS. 1 and 4, and with a central aperture 82 which fits about the outer cylinder 70 of the carrier 60. Three slots extend radially outwardly from the aperture 82 to accommodate three spacers 100. Slot 84 in the lid 80 is shown receiving the upper portion of the spacer 100 in FIG. 2.

The wire dispenser apparatus 10 is secured together by bolt 200, which is shown as including a hex head 202, a shank 204 connected to and extending downwardly from the head, and a lower threaded portion 206. The bolt is oriented with respect to the carrier and the base with the head 202 disposed on a flat washer 210 and with the threaded portion 206 extending through the circular boss 26 of the base 20 and into the socket 33 of the base. A nut 208 is disposed in the socket 33 and receives the threaded portion 206 of the bolt to secure the apparatus together.

The flat washer 210 comprises a bearing surface between the head 202 of the bolt and the flange 66 of the inner cylinder 64 of the carrier 60. The ease of rotation of the carrier 60 with respect to the base 20 is controlled by the tightening of the bolt 200 relative to the carrier 60 and the base 20. By tightening the bolt, the frictional engagement between the carrier 60 and the base 20 is increased, thus decreasing the ease with which the carrier 60 rotates relative to the base 20. Conversely, by loosening the bolt 200 with respect to its nut 208, the frictional engagement between the base and the carrier is decreased, thus allowing the carrier to rotate more freely relative to the base. It will be noted that the tub 40 rotates relatively freely and without any direct engagement between the carrier and the tub, and with only a bearing engagement between the tub and the base due to the weight of the tub bearing against the top surface 23 of the base by means of the circular runner 44 extending downwardly from the bottom 42 of the tub.

FIG. 4 is a top view of the wire dispenser apparatus 10 of FIG. 1. The outwardly extending rim 50 of the tub 40 is shown as being circular in configuration. Within the tub 40 is the lid 80, with its central aperture 82 disposed about the outer cylinder 70 of the carrier 60. The inner cylinder 60 is shown spaced apart from the outer cylinder 70 and disposed on the vertical access of the wire dispenser apparatus 10.

The head 2 to the bolt 200 (see FIGS. 2) is shown disposed against a washer 210. The washer 210 is in turn disposed on the top flange or head 66 of the inner cylinder 60. Three slots 84, 86, and 88 extend radially outwardly from the aperture 82 in the lid 80. The slots 84, 86, and 88 are spaced apart equally from each other, and are thus disposed about 120° apart.

The two windows 90 and 92 are shown extending through the lid 80 and oriented diametrically opposite each other. It will be noted that the windows are located preferably closer to the outer periphery of the lid 80 than to the aperture 82. However, this is merely for convenience in observing the coil of wire disposed beneath the lid 80.

The hinge 54 and the handle 56 are both shown in phantom in FIG. 4. As previously indicated, if desired, a top may be secured to the hub by means of hinge 54. A handle, matching handle 56, may be included on such top to allow the matching handles to be used to carry the apparatus, The hinge and handle are shown diametrically oriented with respect to each other.

Since the lid 80 is disposed on the carrier 60 it rotates therewith. Obviously a top will not rotate, and accordingly the top must be disposed above the top of the spaces to allow them to rotate freely with the carrier. However, to keep the wire within the tub, the outer cylinder 70 should extend upwardly through an aperture in the top, in a manner comparable to the lid 80, as shown in FIG. 2. In addition to a central aperture, the top should also include windows through which to observe the wire coil within the tub. With a top, the lid 80 may or may not be required.

Figure 5:
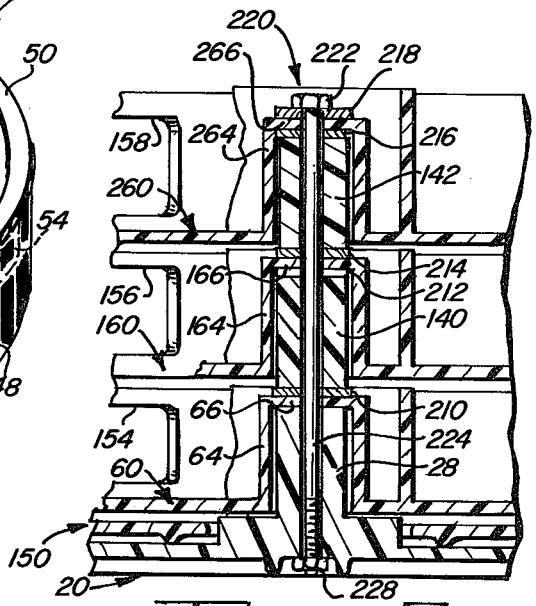
FIG. 5 is a schematic view of an alternate embodiment of the apparatus of FIGS. 1–5, comprising a multi-level wire dispenser apparatus.

FIG. 5 is a schematic representation of a multilevel wire dispenser apparatus, and thus comprises an alternate embodiment of the apparatus of FIGS. 1 and 2, but utilizing the base 20, the carrier 60, and including an additional pair of carriers 160 and 260 spaced apart vertically from each other but coaxially connected together with an elongated bolt 220, all disposed in a tub 150 which is substantially identical to tub 40 except for having a cylindrical wall 152 which is somewhat higher than the wall 42 of tub 40.

Three windows, window 154, window 156, and window 158 are shown extending through the wall 152 at different levels, corresponding to the respective carriers 60, 160 and 260. The windows, and more windows may be provided about the periphery of the tub, are provided for viewing the coils of wire within the tub on the respective carriers.

The base 20 is shown in the same orientation as in FIG. 2, with the inner cylinder 66 of the carrier 60 disposed about the cylinder 28 of the base 20. The washer 210 is shown on the top of the flange 66 of the inner cylinder 64. The washer 210 comprises a bearing surface between the flange 66 of the carrier 60 and a sleeve 140. Another washer 212 is disposed on the top of the sleeve 140 and the washer 212 comprises a bearing surface between the carrier 160, which is substantially identical to the carrier 60, and the sleeve 140. The carrier 160 includes an inner cylinder 164 closed by an inwardly extending flange 166 which bears against the washer 212. On top of the inwardly directed flange 166 is another flat washer 214 and another sleeve 142 is disposed on the washer 214. Another flat washer 216 is disposed on the sleeve 142.

The top or third carrier 260 is, like carrier 160, substantially identical to the carrier 60. It includes an outer cylindrical portion and an inner cylindrical portion 266 which also has a top inwardly directed flange or head 266 which is in turn disposed on the washer 216. Finally, a washer 218 is disposed on the top surface of the flange 266 and beneath the head of a bolt 220. The bolt 220 includes a head 222 and a shank 224 which is elongated to extend through the sleeves, washers, and flanges of the respective portions of the apparatus. The bolt is secured to the apparatus by a nut 228 at the bottom of the base 20. As in the embodiment of FIGS. 1 and 2, the frictional engagement between the carriers 60, 160, and 260 and the base 20 is controlled by the tightening of the bolt 220 and its nut 228.

In order to dispense wire from each of the carriers, a vertically elongated tub is required. That is, the cylindrical walls of a tub for the embodiment of FIG. 5 are of sufficient height to enclose the carriers 60, 160, and 260. Three dispensing apertures (not shown), each similar to aperture 52 illustrated in FIG. 1, extend through the wall 152 of the tub for dispensing of wire from the triple-decker apparatus schematically illustrated in FIG. 5. Only a single lid is required for the top carrier 260 in the embodiment of FIG. 5 since the plates of the carriers 160 and 260 act as lids for the carriers 60 and 160, respectively.

While the principals of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Apparatus for dispensing wire from a coil, comprising, in combination:

base means;

tub means rotatably disposed on the base means;

carrier means disposed in the tub and rotatable therein independently of the tub means for supporting a coil of wire to be dispensed;

lid means disposed on the carrier means for maintaining the coil of wire on the carrier means; and means for securing the carrier means to the base means.

2. The apparatus of claim 1 in which the tub means includes a bottom disposed on the base means and a cylindrical wall portion extending upwardly from the base means.

3. The apparatus of claim 2 in which the tub means further includes an aperture extending through the cylindrical wall portion through which the wire is dispensed.

4. The apparatus of claim 3 in which the carrier means includes a plate spaced apart from the bottom of the tub means and a first cylinder extending upwardly from the plate and the coil of wire is disposed about the first cylinder on the plate.

5. The apparatus of claim 1 in which the base means includes:

a generally circular platform;

a boss extending upwardly from the platform and located centrally with respect to the platform;

a cylinder extending upwardly from and generally coaxially with the boss; and a passageway extending through the cylinder, the boss, and the platform for receiving the means for securing the carrier means to the base means.

6. The apparatus of claim 5 in which the tub means includes a bottom portion, an aperture extending through the bottom portion through which the boss extends, and a cylindrical wall portion extending upwardly from the bottom portion.

7. The apparatus of claim 6 in which the carrier means includes:

a plate for receiving the coil of wire;

an outer cylinder about which the coil of wire is disposed;

an inner cylinder spaced apart from the outer cylinder; and an inwardly directed flange on the inner cylinder comprising a head for the inner cylinder and disposed on the cylinder of the base means.

8. The apparatus of claim 7 in which the inner cylinder includes an aperture extending through the flange for receiving the means for securing the carrier means to the base means.

9. The apparatus of claim 7 in which the carrier means further includes slot means on the outer cylinder and spacer means cooperating with the slot means for increasing the effective diameter of the outer cylinder.

10. The apparatus of claim 9 in which the slot means comprises a plurality of slots spaced apart from each other on the outer cylinder, and each slot extends upwardly from a web for receiving the spacer means.

11. The apparatus of claim 10 in which the spacer means includes a spacer having a recess and a pair of grooves for mutually cooperating with a web and a slot of the slot means.

12. The apparatus of claim 11 in which the spacer means includes a plurality of spacers for cooperating with the plurality of slots, and each spacer includes a pair of recesses, and each recess includes an adjacent pair of grooves, for selectively increasing the effective diameter of the outer cylinder by positioning one of the recesses of the spacers in a slot in the outer cylinder.

13. The apparatus of claim 9 in which the lid means includes a central aperture for receiving the outer cylinder and slot means communicating with the central aperture for receiving the spacer means.

14. The apparatus of claim 13 in which the lid means further includes window means for viewing the coil of wire on the carrier means.

* * * * *